US008382552B2

(12) United States Patent
Su

(10) Patent No.: US 8,382,552 B2
(45) Date of Patent: Feb. 26, 2013

(54) SIMULATED EYE

(75) Inventor: Xiao-Guang Su, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 470 days.

(21) Appl. No.: 12/562,148

(22) Filed: Sep. 18, 2009

(65) Prior Publication Data

US 2010/0120328 A1 May 13, 2010

(30) Foreign Application Priority Data

Nov. 12, 2008 (CN) ..... 2008 1 0305515

(51) Int. Cl.
*A63H 3/28* (2006.01)

(52) U.S. Cl. ..... 446/392; 446/389

(58) Field of Classification Search ..... 446/389, 446/392; 623/4.1
See application file for complete search history.

(56) References Cited

U.S. PATENT DOCUMENTS 5,000,714 A * 3/1991 Su ..... 446/392
5,061,279 A * 10/1991 Friel ..... 623/6.64
5,108,427 A * 4/1992 Majercik et al. ..... 623/5.12
6,638,073 B1 * 10/2003 Kazimirov et al. ..... 434/272

* cited by examiner

*Primary Examiner* — Gene Kim
*Assistant Examiner* — Alyssa Hylinski
(74) *Attorney, Agent, or Firm* — Altis Law Group, Inc.

(57) ABSTRACT

A simulated eye includes a semi-spherical eyeball with a light-transmitting area, a light source, a light transmitting board, and a photochromic layer. The light transmitting board disposed between the eyeball and the light source faces the light-transmitting area. The light transmitting board includes a first portion and a second portion surrounding the first position. The first portion is in a first color. The second portion is in a second color other than the first color. The photochromic layer is formed by photochromic materials coated on a side of the second portion facing the light source. When the light source is turned on, the emitted light irradiates the photochromic layer, whereby an area of the second portion covered by the photochromic layer changes from the second color to a third color similar to or the same as the first color.

11 Claims, 5 Drawing Sheets

SIMULATED EYE

BACKGROUND

1. Technical Field

The present disclosure relates to replicas of human organs, and particularly to a replica of an eye.

2. Description of Related Art

A typical replica of a human eye allow such simulations as the eyelid opening and closing. Accordingly, other simulation effects are needed to make the eyes more lifelike.

Therefore, what is needed is a simulated eye capable of replicating human eye behavior.

DETAILED DESCRIPTION

Figure 1:
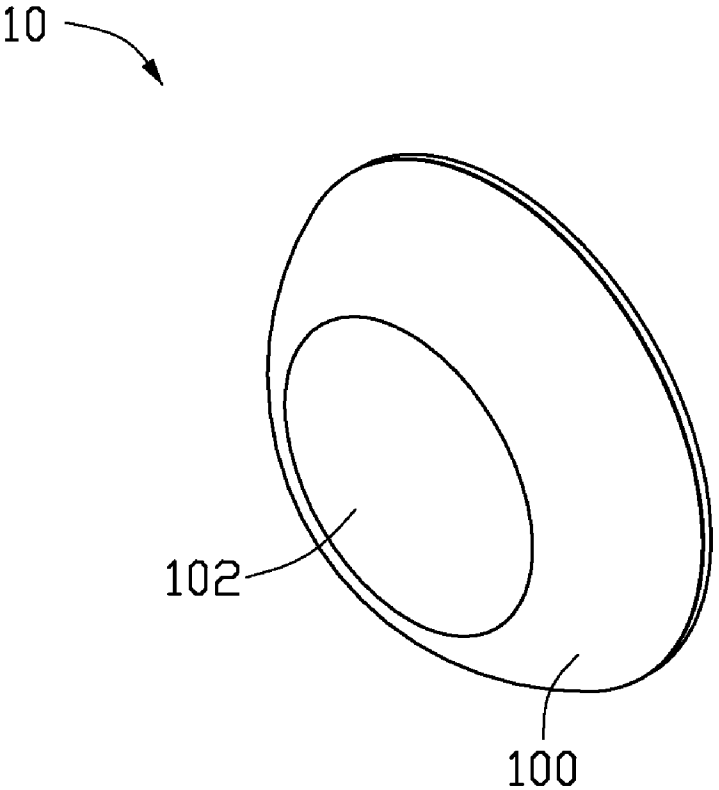
FIG. 1 is an isometric view of a simulated eye in accordance with an exemplary embodiment.
Figure 2:
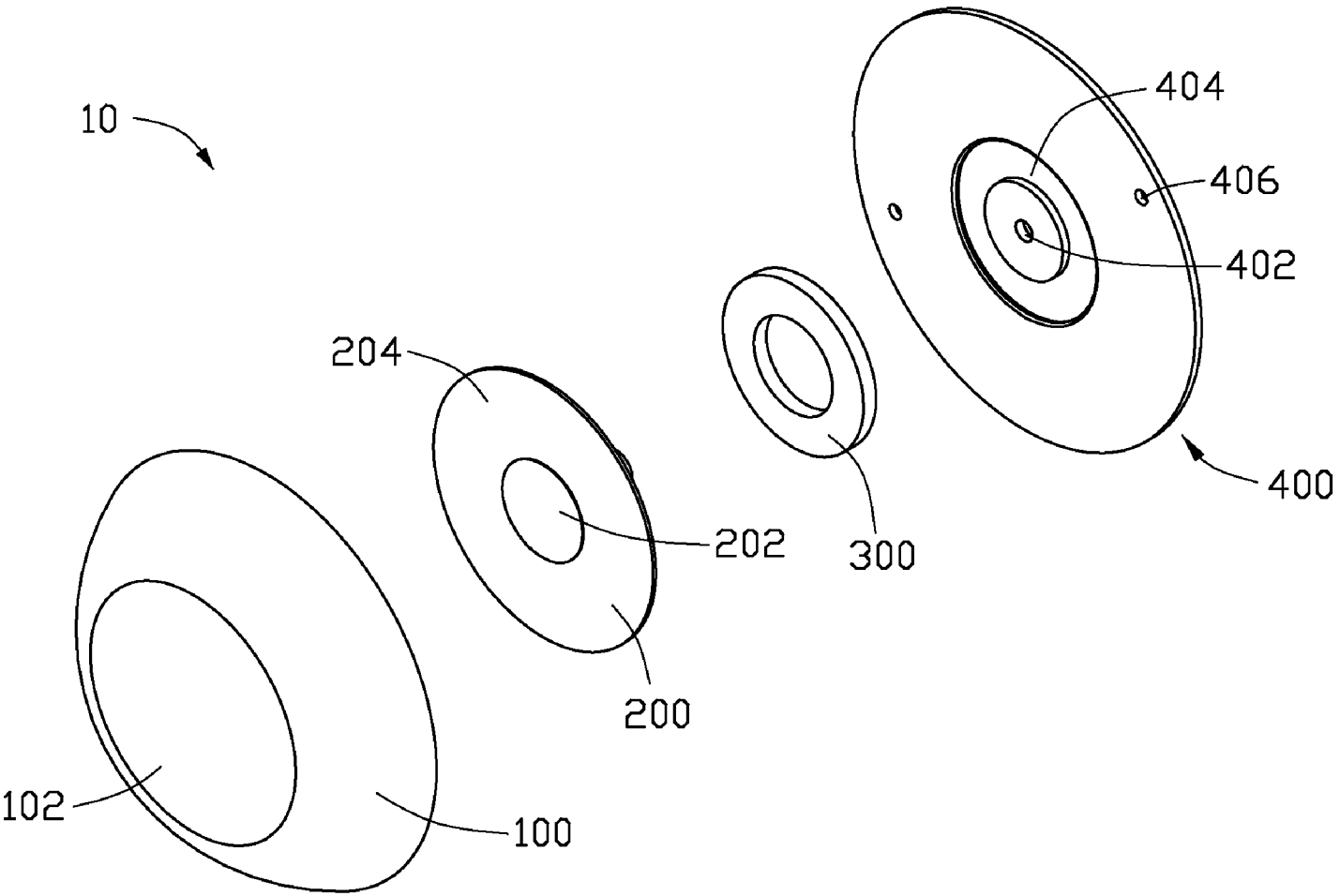
FIG. 2 is an exploded view of the simulated eye of FIG. 1.
Figure 3:
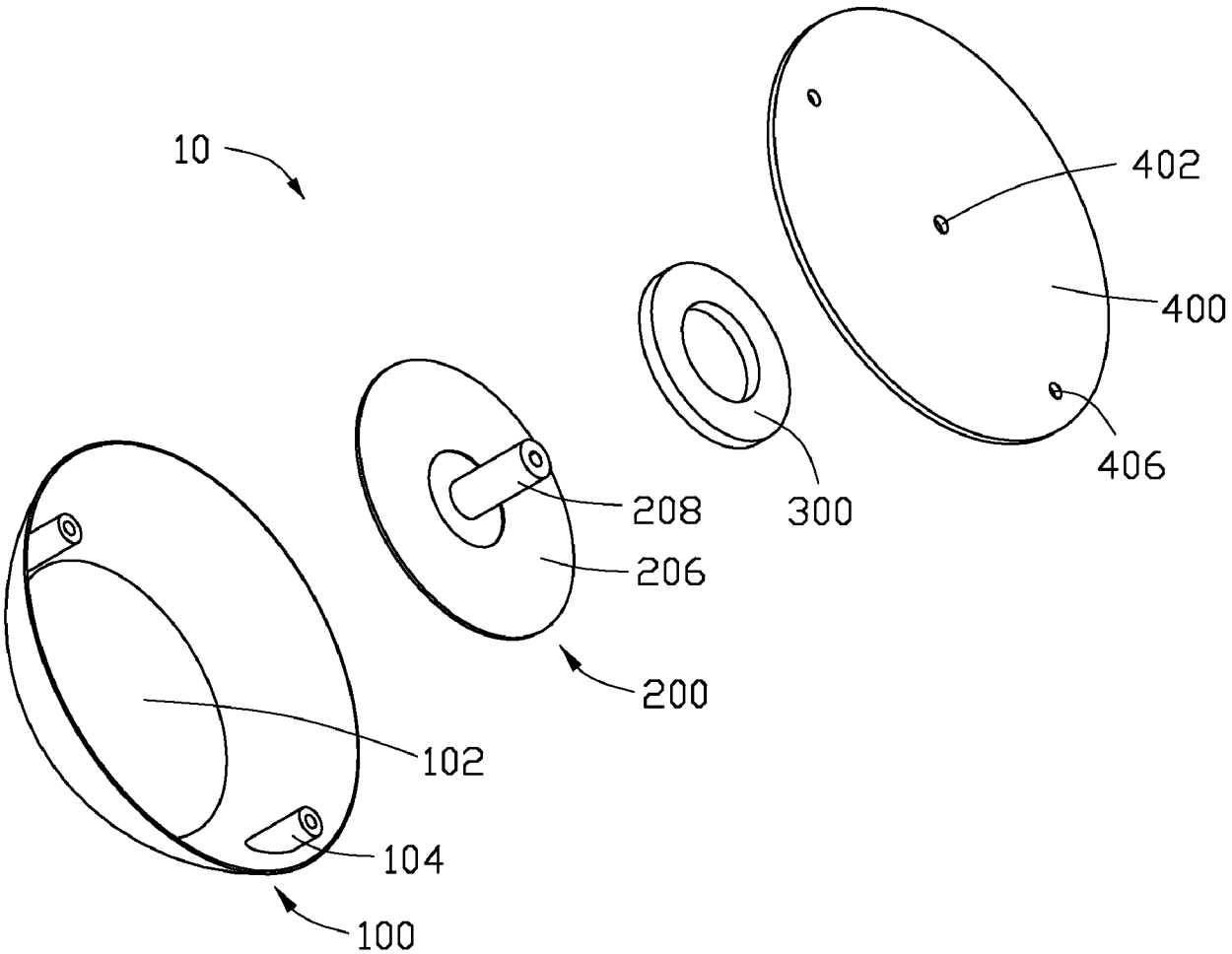
FIG. 3 is an exploded view of the simulated eye of FIG. 1 but viewed from a reverse perspective to FIG. 2.

Referring to FIGS. 1 to 3, a simulated eye 10 includes a substantially semi-spherical cap eyeball 100, a baseboard 400 fixed on a back of the semi-spherical eyeball 100, a circular light-transmitting board 200, and an annular light source 300. The light-transmitting board 200 and the light source 300 are received in the eyeball 100 and fastened on a side of the baseboard 400 facing the eyeball 100.

The eyeball 100 has a circular transparent area 102 capable of transmitting light. The transparent area 102 is arranged on the front of the eyeball 100. In another embodiment, the eyeball 100 may define an opening in the front of the eyeball 100 other than the transparent area 102. The eyeball 100 further includes two fixing posts 104 protruding from an inner surface of the eyeball 100, and the transparent area 102 is disposed between the two fixing posts 104. The two fixing posts 104 may be threaded posts.

The baseboard 400 defines a first through hole 402, an annular slot 404, and two second through holes 406. The slot 404 is defined in the center of the baseboard 400 and between the two second through holes 406. The first through hole 402 is defined in the center of the slot 404. The two second through holes 406 may engage the two fixing posts 104 correspondingly by two fasteners, such as screws (not shown) to fasten the baseboard 400 to the eyeball 100.

The light-transmitting board 200 is disposed between the eyeball 100 and the light source 300. The light-transmitting board 200 is made of transparent material and faces the transparent area 102. The light-transmitting board 200 includes a circular first portion 202 and an annular second portion 204 surrounding the first portion 202. The first portion 202 is in a first color such as black for replicating an unchanging portion of a pupil. The second portion is in a second color other than the first color such as green.

Figure 4:
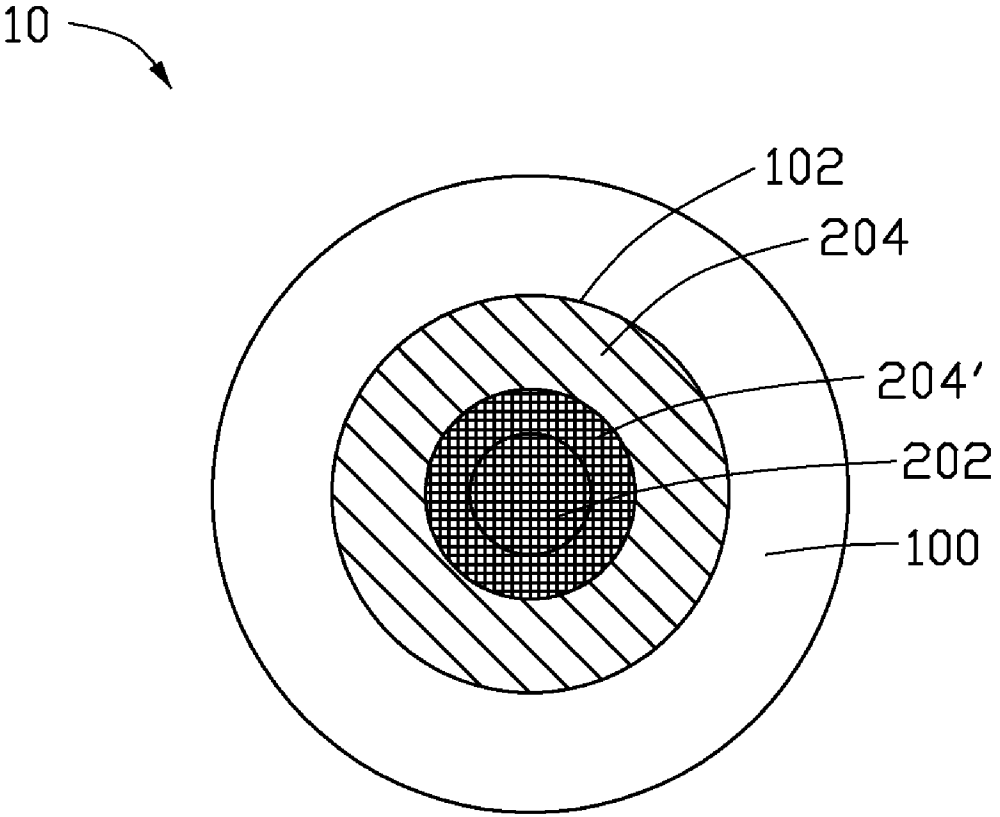
FIG. 4 is a schematic view of the simulated eye of FIG. 1 in a first state.

Photochromic materials are coated on a side of the second portion 204 facing the light source 300 to form an annular photochromic layer 206. In this embodiment, a color of the photochromic layer 206 is white. The photochromic layer 206 surrounds the first portion 202 and connects with an outside edge of the first portion 202. The photochromic layer 206 may partially or fully cover the second portion 204. In this embodiment, the photochromic layer 206 partially covers the second portion 206. Referring to FIG. 4, an area 204' of the second portion 204 covered by the photochromic layer 206 selectively replicates a changeable portion of the pupil or iris. The other area of the second portion 204 uncovered by the photochromic layer 206 replicates an unchanging portion of the iris.

The light source 300 is received in slot 404. The light source irradiates the photochromic layer 206, such that the area 204' of the second portion 204 covered by the photochromic layer 206 changes color. In this embodiment, the light source 300 is a parallel light source, and the photochromic materials may be silver halide, polystyrene-butadiene, or other.

The simulated eye 10 further includes a cylindrical fixing member 208 received in the eyeball 100. One end of the fixing member 208 is connected to the first portion 202 at a side of the photo chromic layer 206. The other end of the fixing member 208, after passing though the light source 300, engages a fastener such as a screw (not shown) after passing through the first through hole 402, to fasten the fixing member 208, the light source 300 and the baseboard 400 together.

Referring to FIG. 4, in use, when the light source 500 is turned on to emit light, the light irradiates the photochromic layer 206, such that the area 204' of the second portion 204 covered by the photochromic layer 206 changes from the second color to a third color similar to or the same as the first color. Accordingly, the area 204' of the second portion 204 covered by the photochromic layer 206 replicates a portion of the pupil, the replicated pupil including the first portion 202 and the area 204' of the second portion corresponding to the photochromic layer 206, such that dilation of the pupil is replicated.

Figure 5:
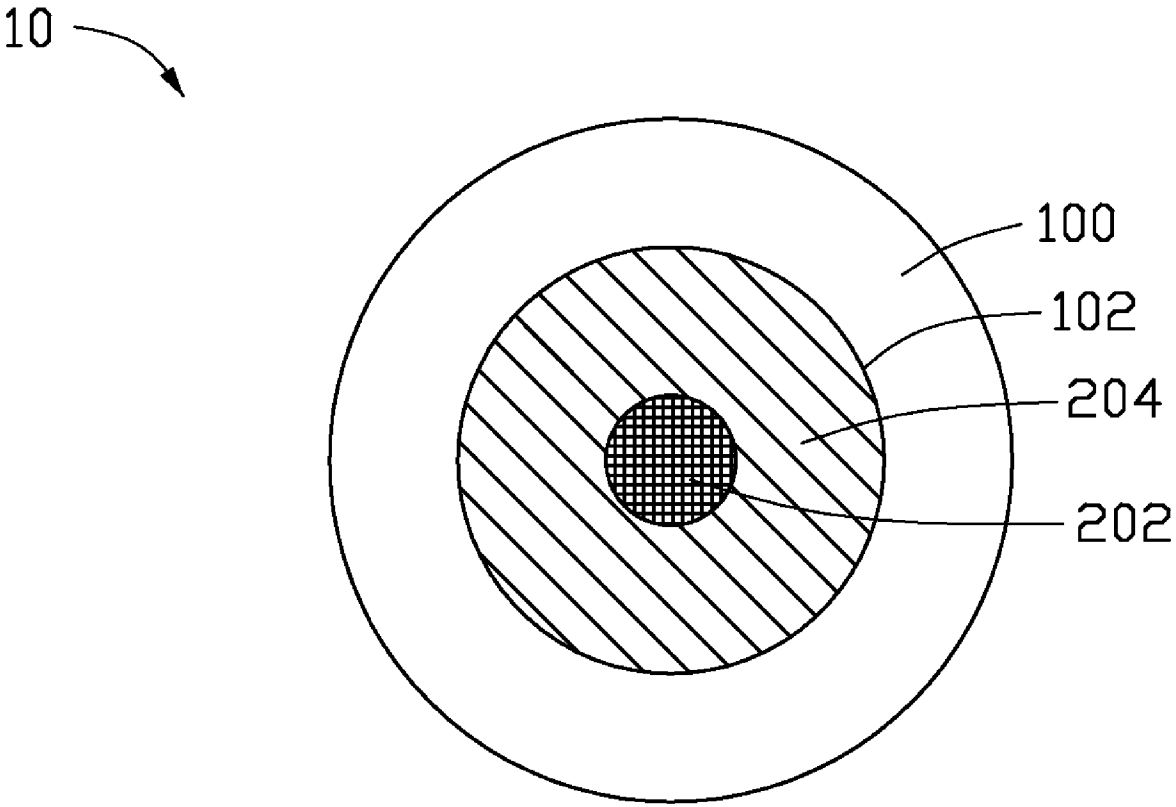
FIG. 5 is a schematic view of the simulated eye of FIG. 1 in a second state.

Referring to FIG. 5, when the light source 500 is turned off, the area 204' of the second portion 204 covered by the photochromic layer 206 changes from the third color to the second color. That is, the area 204' of the second portion 204 covered by the photochromic layer 206 replicates a portion of the iris. Therefore, the pupil is only composed of the first portion 202, such that contraction of the pupil is replicated.

It is to be understood, however, that even though numerous information and advantages of the present embodiments have been set forth in the foregoing description, together with details of the structures and functions of the present embodiments, the disclosure is illustrative only; and that changes may be made in detail, especially in matters of shape, size, and arrangement of parts within the principles of the present embodiments to the full extent indicated by the broad general meaning of the terms in which the appended claims are expressed.

What is claimed is:

1. A simulated eye, the simulated eye comprising:

an eyeball being semi-spherical with a light-transmitting area;

an annular light source for emitting light;

a light transmitting board disposed between the eyeball and the light source and facing the light-transmitting area, the light transmitting board comprising a first portion and a second portion surrounding the first portion; the first portion being a first color, the second portion being a second color other than the first color;

a photochromic layer, comprising photochromic materials coated on a side of the second portion facing the light source;

a baseboard fastened to the eyeball, defining an annular slot for receiving the annular light source; and a fixing member, comprising a first end connected to the first portion of the light-transmitting board and a second end opposite to the first end engaging the baseboard after passing through the annular light source; wherein when the light source is turned on, the emitted light irradiates the photochromic layer, and an area of the second portion covered by the photochromic layer changes from the second color to a third color similar to or the same as the first color.

2. The simulated eye according to claim 1, wherein when the light source is turned off, the area of second portion covered by the photochromic layer changes from the third color to the second color.

3. The simulated eye according to claim 1, wherein the light source is a parallel light source configured to emit parallel light beams.

4. The simulated eye according to claim 1, wherein the photochromic layer connects to an outside edge of the first portion.

5. The simulated eye according to claim 4, wherein the photochromic layer partially covers the second portion.

6. A simulated eye, comprising:

an eyeball being semi-spherical with a light-transmitting area;

a light transmitting board received in the eyeball, the light transmitting board comprising a first portion and a second portion surrounding the first portion; the first portion being a first color and replicating an unchanging portion of a pupil, and the second portion being a second color other than the first color;

a photochromic layer, comprising photochromic materials coated on the second portion, the second portion covered by the photochromic replicating changeable portion of the pupil;

an annular light source irradiating the photochromic layer and changing an area of the second portion covered by the photochromic layer from the second color to a third color similar to the first color, thereby replicating a portion of the pupil, such that the pupil composed of the first portion and the area of the second portion covered by the photochromic layer is viewable from the light-transmitting portion to replicate dilation;

a baseboard fastened to the eyeball, defining an annular slot for receiving the annular light source; and a fixing member, comprising a first end connected to the first portion of the light-transmitting board and a second end opposite to the first end engaging the baseboard after passing through the annular light source.

7. The simulated eye according to claim 6, wherein the second portion uncovered by the photochromic layer replicates an unchanging portion of the iris, the second portion covered by the photochromic layer selectively replicating the changeable portion of the pupil and a changeable portion of the iris.

8. The simulated eye according to claim 7, wherein when the light source is turned off, the second portion covered by the photochromic layer changes from the third color to the first color, for replicating a portion of the iris, such that the pupil composed of the first portion is viewable from the light-transmitting portion to replicate contraction.

9. The simulated eye according to claim 6, wherein the light source is a parallel light source configured to emit parallel light beams.

10. The simulated eye according to claim 6, wherein the photochromic layer connects to an outside edge of the first portion.

11. The simulated eye according to claim 10, wherein the photochromic layer partially covers the second portion.

* * * * *